US005148954A

United States Patent [19]

Myers

[11] Patent Number: 5,148,954

[45] Date of Patent: Sep. 22, 1992

[54] ADJUSTABLE CAP SHAPER

[76] Inventor: Clifford J. Myers, 1103 E. 25th St., Apt. 3, Cheyenne, Wyo. 82001

[21] Appl. No.: 724,753

[22] Filed: Jul. 2, 1991

[51] Int. Cl.[5] ..... A42C 1/00

[52] U.S. Cl. ..... 223/25; 223/24

[58] Field of Search ..... 223/24, 25, 26

[56] References Cited

U.S. PATENT DOCUMENTS

| | | | |
|---|---|---|---|
| 1,845,076 | 2/1932 | Copeland | 223/24 |
| 1,875,178 | 8/1932 | Phares | 223/25 |
| 2,713,444 | 7/1955 | Dombrowski | 223/25 |
| 3,036,698 | 5/1962 | Gronemeyer | 223/24 |
| 3,447,726 | 6/1969 | George | 223/25 |
| 4,491,256 | 1/1985 | Payne et al. | 223/24 |
| 4,708,271 | 11/1987 | Grommes | 223/25 |

*Primary Examiner*—Werner H. Schroeder
*Assistant Examiner*—Diana L. Biefeld
*Attorney, Agent, or Firm*—Dean P. Edmundson

[57] ABSTRACT

An adjustable cap shaper is described for supporting a cap during drying. The cap shaper includes a crown portion having a ring-shaped band and a plurality of arch members which converge towards each other and are held in the desired position by a connector. The arch members and the band are adjustable so that the cap shaper can be adjusted as to size and shape. The cap shaper can be used to support any type or size of cap for drying.

15 Claims, 4 Drawing Sheets

ADJUSTABLE CAP SHAPER

FIELD OF THE INVENTION

This invention relates to devices and techniques used for shaping caps. More particularly, this invention relates to devices and techniques used for supporting and holding cloth caps after laundering to prevent the caps from shrinking and wrinkling.

BACKGROUND OF THE INVENTION

Cloth caps are commonly worn and used by people in all types of industries and business. After these caps have been used for a while they usually become dirty or soiled and must be laundered. Although the caps can be hand washed or machine laundered to remove dirt and grime, they usually shrink or wrinkle badly upon drying. Such caps also normally include cardboard stays in the visors or crown portions which help the caps to hold their desired shape when they are new. After the cap is laundered, however, these types of stays wrinkle and cause the cap to take on an undesirable shape.

Although various types of drying racks have been known for supporting other types of articles while they are drying after being laundered, a simple and practical means for supporting a cap for drying after being laundered has not previously been provided.

U.S. Pat. No. 4,491,256 describes a rigid drying insert for caps which have been laundered. However, such device has a number of drawbacks and disadvantages. For example, such device is not adjustable in size. Accordingly, one of such devices may only accommodate caps which are very close to the size of the insert. Although many caps themselves are adjustable in size, baseball caps and better quality caps are not adjustable in size. Consequently, several separate inserts would have to be manufactured to accommodate several different sizes of caps.

Also, the device of U.S. Pat. No. 4,491,256 has rounded or curved dome arches. However, some caps are produced with a flat crown (e.g., winter caps and hunting caps). Consequently, such types of caps would not be properly supported for drying by the device of U.S. Pat. No. 4,491,256, and wrinkling or shrinking of the top of the cap would result. Further, a cap may slip upwardly on the insert while drying if it shrinks too much.

Also, the device of U.S. Pat. No. 4,491,256 includes a flat bill or visor support portion to which the bill or visor of a cap is to be clipped or secured for drying. The patent also describes the use of a separate flat visor plate, with the visor of the cap being sandwiched between the plate and the flat bill portion to hold the cap visor in a flattened condition for drying. As another alternative, the visor of the cap can be secured to the flat bill portion by means of rubber bands during drying. This procedure adds additional complexity and cost to the drying procedure.

For the foregoing reasons, the insert device of U.S. Pat. No. 4,491,256 has limited utility and is not considered to be practical for use in drying laundered caps.

SUMMARY OF THE PRESENT INVENTION

In accordance with the present invention there is provided an adjustable cap shaper which is very effective for supporting caps for drying after they have been laundered. The cap shaper may be used for desirably and effectively supporting any type or size of cap while drying so that the proper shape and size of the cap is maintained and so that the cap does not wrinkle during drying.

In one embodiment the adjustable cap shaper of the invention comprises:

(a) a crown portion comprising a ring-shaped band member having a plurality of upwardly extending arch members secured thereto; wherein the arch members are flexible and each includes a free upper end; wherein the band member includes adjustment means for enabling the diameter of the band member to be adjusted; and (b) a connector portion which is attached to the free ends of the arch members to hold them in a manner such that the arch members form a desired shape for the cap.

The arch members are movable with respect to each other and to the connector portion so that the shape of the crown portion may be adjusted to any desired shape. The diameter of the band member may also be adjusted. Thus, the cap shaper of this invention can be placed into any desired shape and size so as to be suitable for any shape and size of cap to be dried. Retention means may be included on the crown portion for preventing the cap from sliding upwardly on the shaper during drying.

Surprisingly, when using the cap shaper of this invention for supporting and shaping a cap while drying, it has been found that there is no need to support the visor or bill portion of the cap.

Other variants are possible without departing from the scope of this invention.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
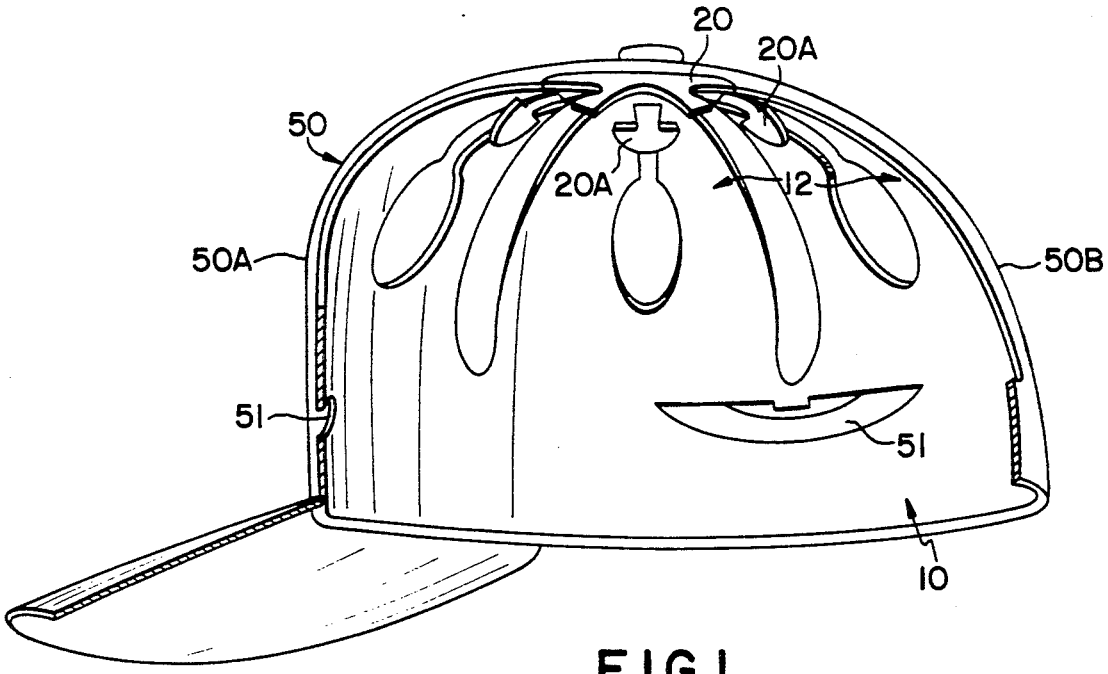
FIG. 1 is a cross-sectional view showing an adjustable cap shaper of the invention being used to support a conventional cap for drying.
Figure 2:
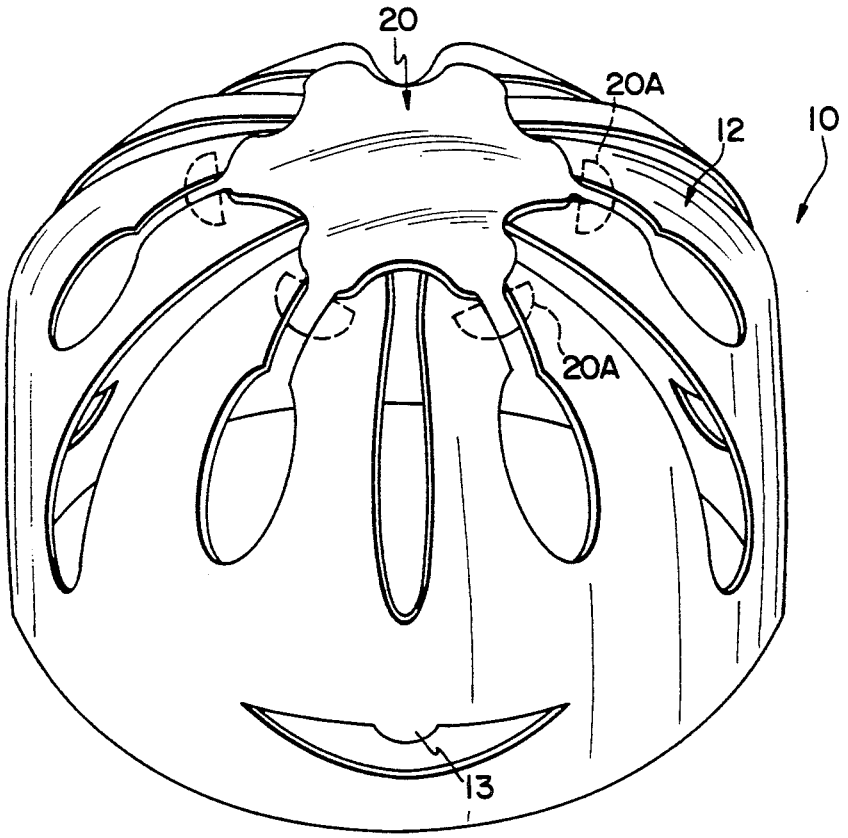
FIG. 2 is a front perspective view of the embodiment of cap shaper shown in FIG. 1.
Figure 3:
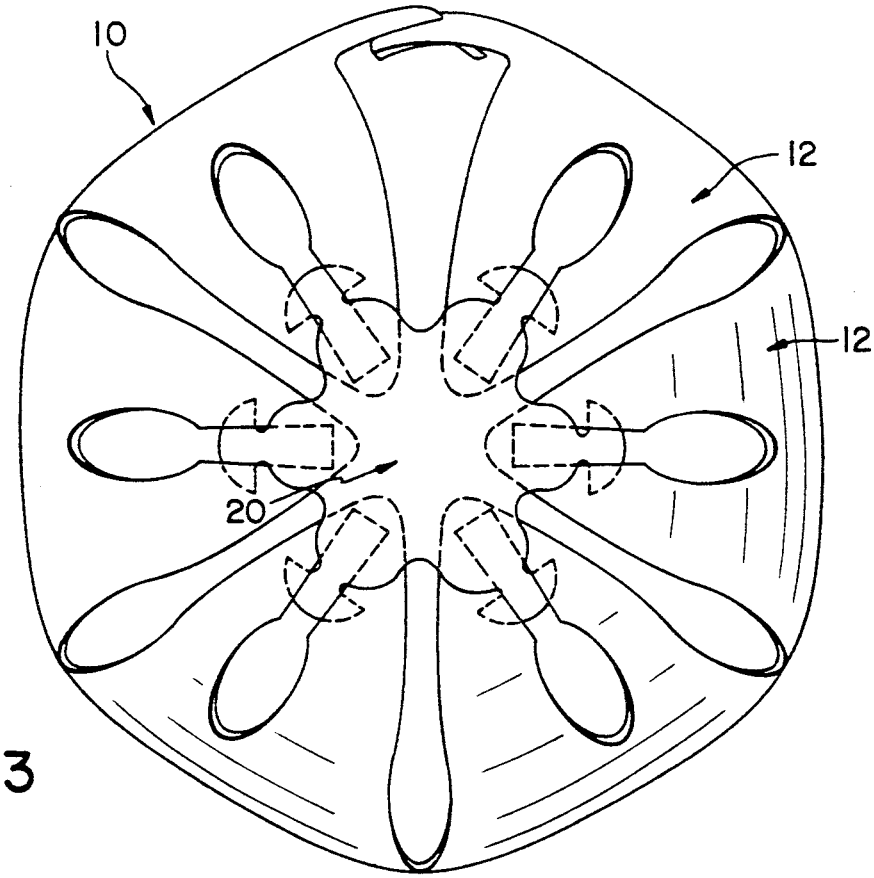
FIG. 3 is a top view of the cap shaper of FIG. 1.
Figure 4:
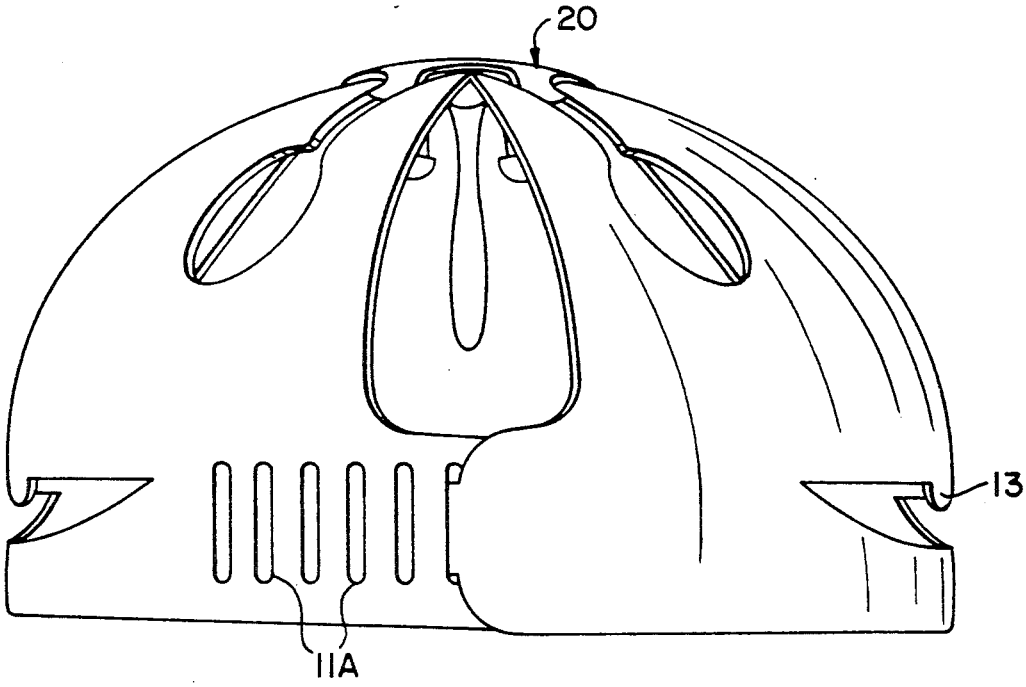
FIG. 4 is a rear elevational view of the cap shaper of FIG. 1.
Figure 5:
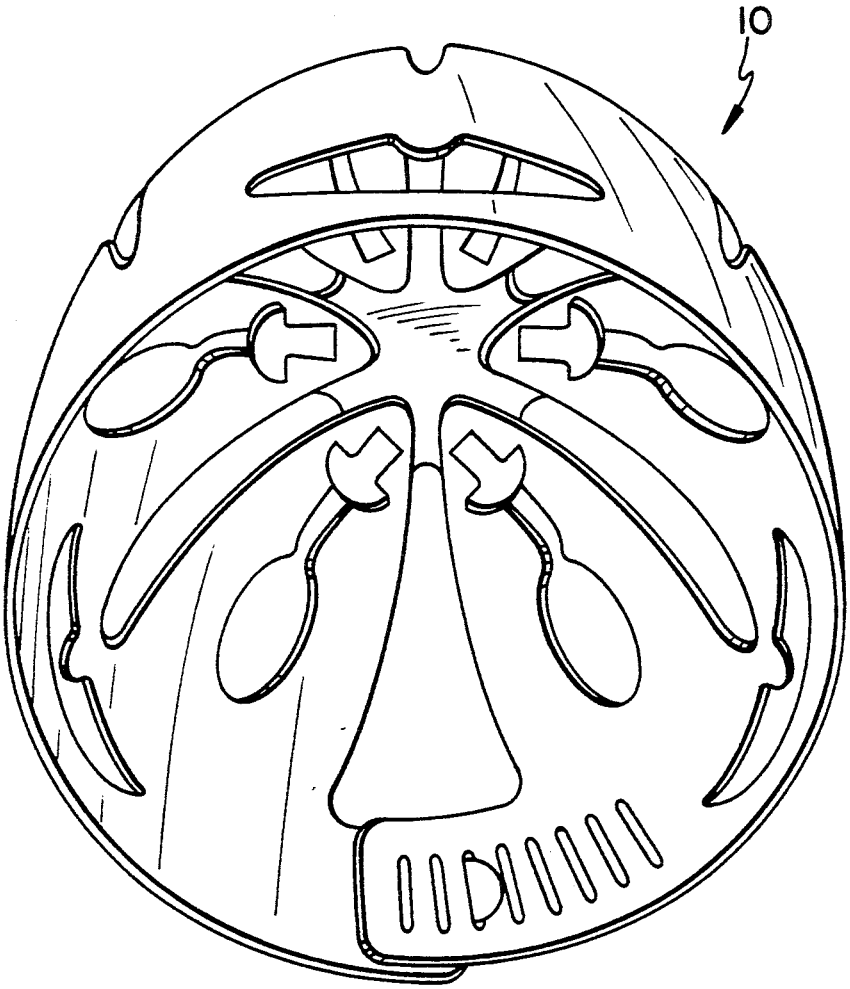
FIG. 5 is a bottom perspective view of the cap shaper of FIG. 1.

In the drawings there is shown a preferred embodiment of an adjustable cap shaper 10 of this invention. The cap shaper includes a crown portion comprising a ring-shaped band member 11 having a plurality of upwardly extending arch members 12 secured thereto. The arch members are flexible and each include a free upper end 12A.

A connector portion 20 is attached to the free ends of the arch members to hold them in a manner such that the arch members form a desired shape for a cap 50 to be dried. The connector 20 includes a plurality of outwardly projecting tab fingers 20A equal to the number of arch member 12.

Figure 6A:
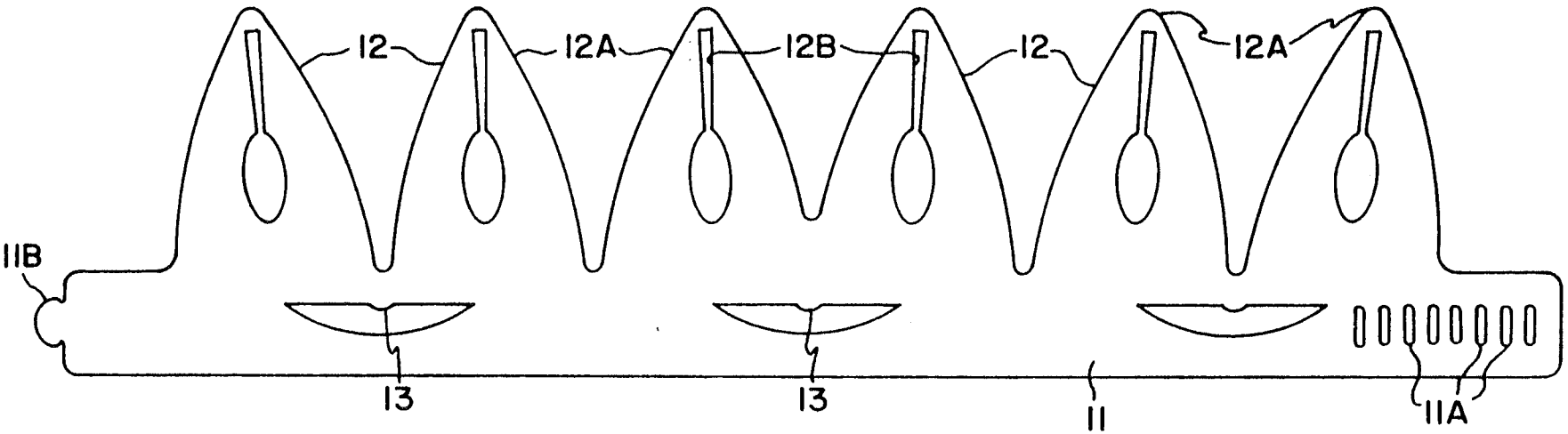
FIGS. 6A and 6B are plan views of the (a) crown portion and band member, and (b) connector portion, respectively, of the cap shaper of the invention.

Each arch member 12 includes an elongated slot 12B, as best illustrated in the plan view of FIG. 6A. Each tab finger 20A on connector 20 is adapted to fit in and engage a slot 12B in a respective arch member.

Because the slots 12B are elongated, and because the arch members are flexible, each arch member can be individually moved or positioned relative to the connector so that any desired crown shape may be achieved. The tab fingers 20A engage the slots 12B in a manner such that the position of the connector portion relative to each arch member is frictionally maintained during the time that a cap is fitted over the cap shaper for drying, yet the relative position of the connector portion and the arch members may be changed as desired so that the cap shaper will have the desired shape for each cap to be dried.

As shown in the drawings, each slot 12B is slightly tapered inwardly from the free end of the arch toward the band 11. The large opening which communicates with the slot 12B enables the tab finger 20A to be easily inserted.

As can be seen in FIG. 1, many caps do not have a perfectly hemispherical crown. Instead, many caps have a relatively vertical front crown portion 50A and a sloping rear crown portion 50B. Consequently, in order to prevent shrinking or wrinkling of the front crown portion during drying, the cap shaper must be able to be adjusted so that it presents a nearly vertical front crown portion and a sloping rear crown portion. In this way the cap shaper will maintain the proper shape for the crown of the cap during drying. Prior drying inserts have not had this capability.

Figure 6B:
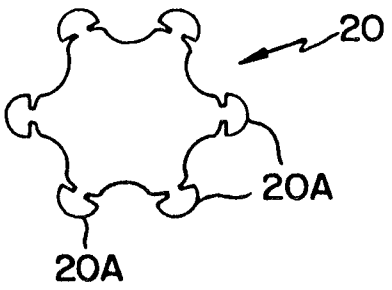

Another feature of the cap shaper of this invention is that it can be easily made from flat sheet material. This is illustrated in FIGS. 6A and 6B. The crown and band sections are integral with each other and are shown in FIG. 6A. The connection portion 20 is shown in FIG. 6B. These items have been stamped or cut from flat sheet stock (e.g., plastic, metal, water-resistant paper, etc.). Preferably the sheet stock is uniform in thickness, and preferably the thickness is in the range of about 0.02 to 0.1 inch. The resulting stamped or cut items should be flexible and resilient so that they can be put into a desired shape and be able to hold that shape when a cap is placed onto it for drying purposes.

There are a plurality of tapered arch members 12 extending upwardly from the band member or portion 11. Normally there are six such arch members, although more or less could be used, if desired. The arch members are shown to be tapered from their lower end (where they are integral with the band) to their free end 12A. Preferably the arch members are approximately of the same size.

The connector portion 20 includes a plurality of tab fingers 20A which are equal in number to the arch members. Each tab finger 20A is adapted to fit in a slot 12B of a respective arch member. In this manner the connector portion 20 forms the apex of the crown when the cap shaper is assembled. Because the slots 12B are elongated, each arch member may be moved relative to the connector 20. This enables the crown portion to be manipulated into any desired shape required for supporting a cap to be dried.

Another feature of the cap shaper of the invention is that it is adjustable in size (i.e., in diameter). The band member includes two ends, one of which includes a plurality of spaced slots 11A and the other of which includes a tab 11B. The two ends are adapted to be detachably connected so as to form any desired diameter.

When the free ends of the arch members are urged toward each other and then attached to the connector 20 they form the crown of the cap shaper, as is illustrated in the drawings.

Yet another feature of the cap shaper of this invention is the provision of retention means to detachably secure the cap to the cap shaper for drying. The retention means may comprise tabs 13 in the band portion 11, for example. These downwardly projecting tabs are adapted to hook onto the top edge of the sweat band 51 of the cap when the cap is positioned on the cap shaper 10. This prevents the cap from sliding upwardly while drying.

It has been found that the adjustable cap shaper described herein can be used for drying any size caps (from children's sizes to very large adult). It can also be made to conform to any shape of crown to prevent shrinking and wrinkling.

It has also been found that when using the cap shaper of this invention there is no need to support the visor or bill of the cap during drying. This is a significant advantage.

Other variants are possible without departing from the scope of this invention.

What is claimed is:

1. An adjustable cap shaper for supporting a cap during drying, wherein said cap shaper comprises:

(a) a crown portion comprising a ring-shaped band member having a plurality of upwardly extending arch members secured thereto; wherein said arch members are flexible and each includes a free upper end; wherein said band member includes adjustment means for enabling the diameter of said band member to be adjusted; and (b) a connector portion which is attached to said free ends of said arch members; wherein the point of attachment of each said arch member to said connector portion is adjustable in a manner such that said arch members form a desired shape for said cap.

2. A cap shaper in accordance with claim 1, wherein said band member further comprises retention means for retaining said cap on said cap shaper.

3. A cap shaper in accordance with claim 2, wherein said retention means comprises a plurality of tab members for detachably gripping said cap.

4. A cap shaper in accordance with claim 1, wherein said band member includes first and second ends; wherein said first end includes a plurality of spaced slots and said second end includes a tab which can be inserted into a selected one of said slots to fix the diameter of said band member.

5. A cap shaper in accordance with claim 1, wherein said arch members are tapered from said band member to their said free ends.

6. A cap shaper in accordance with claim 5, wherein each said arch member includes an elongated slot; wherein said connector portion includes a plurality of tab fingers equal to the number of said arch members; and wherein each said tab finger is inserted into said elongated slot in one of said arch members.

7. A cap shaper in accordance with claim 6, wherein said elongated slot in each said arch member is tapered.

8. A cap shaper in accordance with claim 1, wherein said arch members are integral with said band member; wherein said arch members and said band member are formed from a flat sheet having a thickness in the range of about 0.02 to 0.1 inch.

9. An adjustable cap shaper for supporting a cap during drying, wherein said cap shaper comprises:

(a) a crown portion comprising a ring-shaped band member having a plurality of upwardly extending arch members secured thereto, wherein said arch members are flexible and each includes a free upper end; wherein said band member includes adjustment means for enabling the diameter of said band member to be adjusted; wherein said arch members are tapered from said band member to their said free ends; and (b) a connector portion which is attached to said free ends of said arch members to hold them in a manner such that said arch members form a desired shape for said cap.

10. A cap shaper in accordance with claim 9, wherein said band member further comprises retention means for retaining said cap on said cap shaper.

11. A cap shaper in accordance with claim 10, wherein said retention means comprises a plurality of tab members for detachably gripping said cap.

12. A cap shaper in accordance with claim 9, wherein said band member includes first and second ends; wherein said first end includes a plurality of spaced slots and said second end includes a tab which can be inserted into a selected one of said slots to fix the diameter of said band member.

13. A cap shaper in accordance with claim 9, wherein each said arch member includes an elongated slot; wherein said connector portion includes a plurality of tab fingers equal to the number of said arch members; and wherein each said tab finger is inserted into said elongated slot in one of said arch members.

14. A cap shaper in accordance with claim 13, wherein said elongated slot in each said arch member is tapered.

15. A cap shaper in accordance with claim 9, wherein said arch members are integral with said band member; wherein said arch members and said band member are formed from a flat sheet having a thickness in the range of about 0.02 to 0.1 inch.

* * * * *